United States Patent [19]

Patterson

[11] 3,952,721

[45] Apr. 27, 1976

[54] STOVE WITH COOKING PLATE

[76] Inventor: Tommy W. Patterson, P.O. Box 65, Hayesville, Ohio 44838

[22] Filed: July 10, 1974

[21] Appl. No.: 487,125

[52] U.S. Cl. ..... 126/63; 126/92 R; 126/137; 126/120; 126/126; 126/211; 126/3; 126/4

[51] Int. Cl.[2] ..... F24B 1/26; F24C 15/10

[58] Field of Search ..... 126/92 R, 140, 92 AC, 126/6, 63, 58, 218, 120, 126, 123, 124, 137, 141, 142, 220, 198, 214 D, 121, 4, 211, 3, 164, 165, 288

[56] References Cited

UNITED STATES PATENTS

| | | | |
|---|---|---|---|
| 438,749 | 10/1890 | Elwood | 126/92 R |
| 831,096 | 9/1906 | Posey | 126/137 |
| 1,370,349 | 3/1921 | Nichols | 126/137 |
| 1,424,584 | 8/1922 | Nelson et al. | 126/137 |
| 1,470,542 | 10/1923 | Poling | 126/137 |
| 1,611,983 | 12/1926 | Andrews | 126/92 AC |
| 2,054,953 | 9/1936 | Scotson | 126/211 |
| 2,528,333 | 10/1950 | Biddle et al. | 126/211 |
| 2,789,554 | 4/1957 | Dupler | 126/63 |
| 2,832,332 | 4/1958 | Johnson | 126/121 |
| 2,969,787 | 1/1961 | Dupler | 126/92 R |
| 3,169,516 | 2/1965 | Agnese | 126/121 |
| 3,190,279 | 6/1965 | Davis | 126/121 |
| 3,220,400 | 11/1965 | Yager | 126/63 |
| 3,616,788 | 11/1971 | Hannebaum | 126/140 |
| 3,820,527 | 6/1974 | Koch | 126/137 |
| R15,577 | 4/1923 | Nichols | 126/137 |

FOREIGN PATENTS OR APPLICATIONS

| | | | |
|---|---|---|---|
| 794,607 | 5/1958 | United Kingdom | 126/164 |
| 624,930 | 6/1949 | United Kingdom | 126/164 |
| 205,420 | 10/1923 | United Kingdom | 126/165 |

*Primary Examiner*—John J. Camby
*Assistant Examiner*—Henry C. Yuen
*Attorney, Agent, or Firm*—Oldham & Oldham Co.

[57] ABSTRACT

This stove or fireplace control has a barrier across the lower front portion of the fire chamber to prevent air from flowing in under the grate. The unit when formed as a stove also includes frame means having spaced inner and outer walls with the inner wall defining a fire chamber and with the frame means having air inlet means at a lower portion thereof connecting to the space between the frame walls. A horizontally extending heater duct is provided in the frame means at the top thereof and is open at the front of the stove for receiving air from between the walls and conducting it horizontally and forwardly of the stove for discharge into the room for heating the same. Additionally the stove has an opening in the top thereof and a cooking plate is removably positioned over such opening in the top of the stove for direct exposure to the fire chamber on its lower surface.

5 Claims, 9 Drawing Figures

STOVE WITH COOKING PLATE

BACKGROUND OF THE INVENTION

Heretofore there have been many different kinds of stoves provided, but all of such stoves have usually been relatively inefficient in the amount of heat supplied thereby, the stoves have been unsightly, or the stoves have been quite heavy and costly. Other types of stoves provided heretofore have endeavored to provide some special heat channels therein for aiding in heating the room in which the stove is positioned but such stoves normally have been relatively expensive and have been rather large units positioned in chimney structures.

The general object of the present invention is to provide a novel and improved stove which is relatively efficient in operation and which has a cooking plate provided thereon for cooking or warming food positioned on the stove.

Another object of the invention is to provide a fire chamber having a controlled air supply therefor to obtain a slow rate of combustion for the fuel therein.

Another object of the invention is to provide a relatively uncomplicated stove specially adapted for heating air drawn into the stove and discharging it back into the room in which the stove is positioned; and to extract a maximum amount of heat from the fuel being burned in the stove before passing the combustion gases to an exhaust vent or stack.

Another object of the invention is to provide a special relationship between a draft prevention member and a grate whereby air only is drawn into the stove or fireplace from above the grate means and air will not be drawn through the grate from the lower surface thereof.

Yet another object of the invention is to prevent air flow up through a grate or fireplace to retard the combustion rate.

Yet other objects of the invention are to provide a novel and useful base layer of fire brick in a small room type stove; to provide effective draft controls for the stove; to provide a very useful readily available ash drawer for the stove; to provide a replaceable heat reflective shield in the back of the fire chamber; and to provide a stove adapted to be positioned in the center of a room for effectively heating the same and having no excessively hot outer wall portions formed on the stove.

When referring to corresponding members shown in the drawings and referred to in the specification, corresponding numerals are used to facilitate comparison therebetween.

Reference now is made to the accompanying drawings, wherein.

SUBJECT MATTER OF INVENTION

A barrier is provided to prevent air flow in under a grate.

The stove, as one embodiment of the invention, comprises a frame means including spaced inner and outer walls with the inner wall operatively defining a fire chamber, the frame means having an air inlet opening or member formed therein at a lower portion thereof connecting to the space between the walls, the frame also having a horizontally extending heater duct connecting to the space between the walls and with the duct being at the upper portion of the frame and opened at the front of the stove for receiving air flowing upwardly of the stove and across the upper surface thereof to discharge heated air into the atmosphere adjacent the stove. A normally closed controllable damper means or door is provided in the front lower portion of the stove for ash removal when the door is open and a companion damper means is provided in the outlet portion of the stove where it connects to an outlet duct.

As a further feature of the stove, the top of the frame means has a center opening therein and the metal cook plate is provided for covering such opening and being exposed to the fire chamber on its lower surface for receipt of heat directly from the fire chamber.

Figures 3, 7:
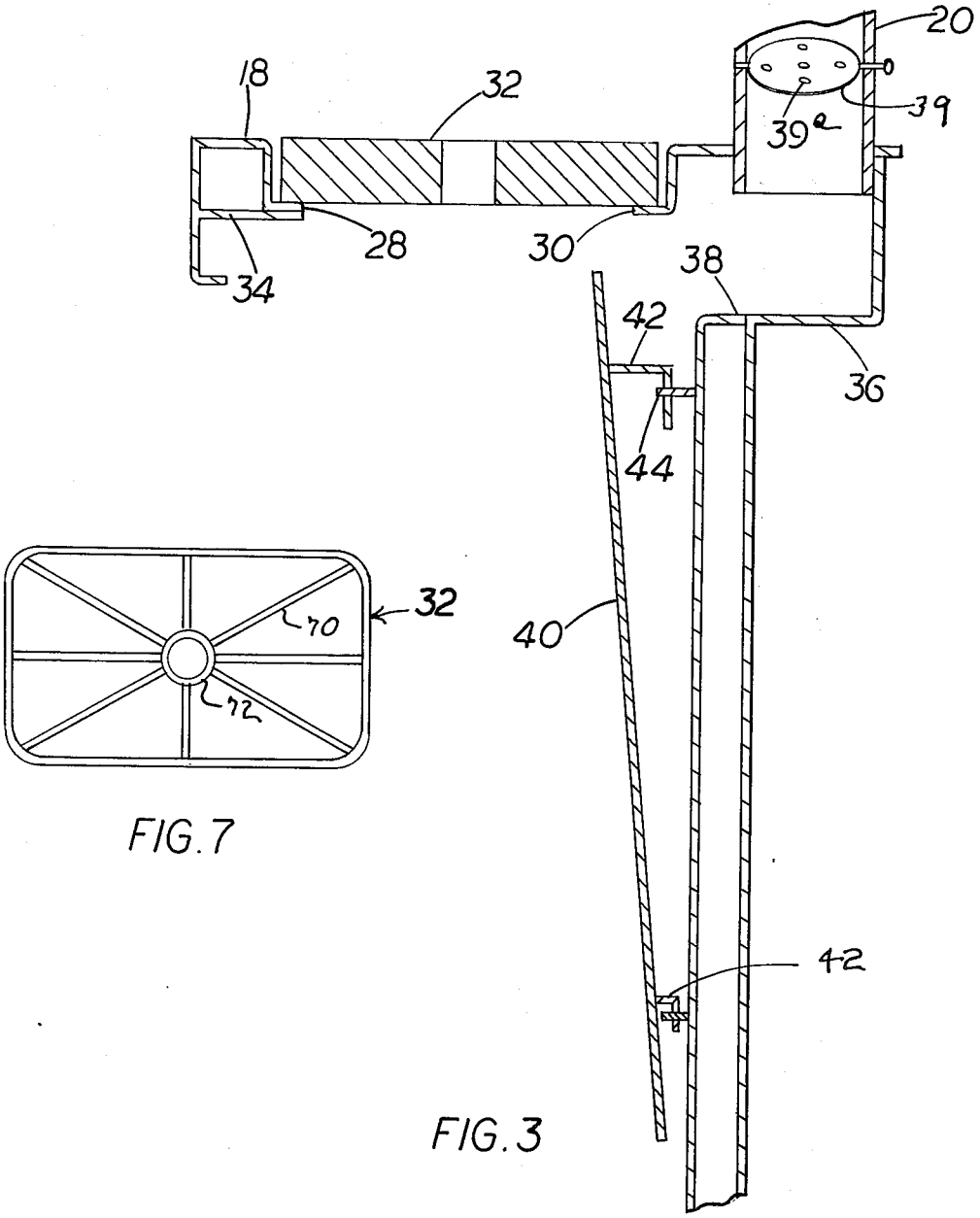
FIG. 3 is a fragmentary vertical section of the stove of FIG. 1 taken on the centerline thereof and with portions of the front of the stove being omitted for clarity.
FIG. 7 is a bottom plan view of the metal cook plate of FIG. 3.

Attention now is particularly directed to the accompanying drawings, and a stove is indicated as a whole by the numeral 10. The stove 10 includes a frame means 12 which includes inner and outer walls 14 and 16, respectively. These inner and outer walls are provided primarily at the side and rear portions of the stove, while the top portion of the frame means for the stove includes a center section 18 which has an exhaust vent or duct 20 connecting to an extended rear portion thereof, as shown in FIG. 3. Side portions are provided in the top section and are indicated at 22 and 24. Such side portions form horizontally extending flues or ducts 26 having sidewalls and spaced upper and lower surfaces or walls that are open to and connect to the spaced area between the inner and outer walls 14 and 16 at the rear portion of the stove, which ducts are open at the front portion of the stove. The center section 18 of the stove has a recessed opening 28 therein having a flange 30 at the margin thereof for receiving and positioning a cast metal cooking plate 32. This plate is exposed on its lower surface to the fire chamber formed in the stove so that such plate 32 will be heated rapidly and continuously when the stove has a fire burning therein. The plate 32 usually is of relatively thick, sturdy construction and any desired lifting flanges or recesses can be formed at the plate margins. Any suitable edge flange means or ribs can be provided on this plate to facilitate retaining cooked articles or utensils thereon or to prevent meat sauces or the like from running off of the cooking plate. The center section 18 has a double walled front margin portion 34 thereon to prevent excessive heat flow through this area thereof.

At the back of the stove, usually an extension box 36 is provided and it connects to the upper end of the fire chamber by a flue opening 38 at the upper end of the fire chamber so that heat and gases exhausting from the fire chamber will pass out through the flue opening 38 into the exhaust or stack or pipe 20. Any conventional type of an apertured damper 39 is provided in the exhaust stack 20 at any suitable area thereof whereby flow of these gases outwardly from the stove can be controlled and the flow can be restricted for retarding the combustion rate of fuel in the stove.

Yet another feature of the stove of the invention is indicated in FIG. 3 that shows a heat reflective plate 40, that can be made from stainless steel or other good heat resistant materials. Such plate may just be removably supported in the stove 10 and thus a pair of support fingers 42 or the like can be provided on the back surface of the reflector plate and protrude therefrom for engaging eyes 44 or the like provided on the back inner layer of the frame means. Hence the reflector plate 40 can be replaced if it becomes charred or burned in use by repeated exposure to the direct combustion action in the fire chamber.

Another feature of the stove 10 to aid in providing a durable fire chamber construction, is that a layer of fire brick 46 is carried on the frame means 12 of the stove. These fire bricks are of any conventional construction and are abutted against each other to provide a continuous support surface and insulation means at the bottom of the stove. The bottom portion of the frame means may have spaced inner and outer walls 47 and 49 as indicated in the drawing, or only one bottom plate may be provided in the frame as desired. The frame 12 has a front 13.

Figure 1:
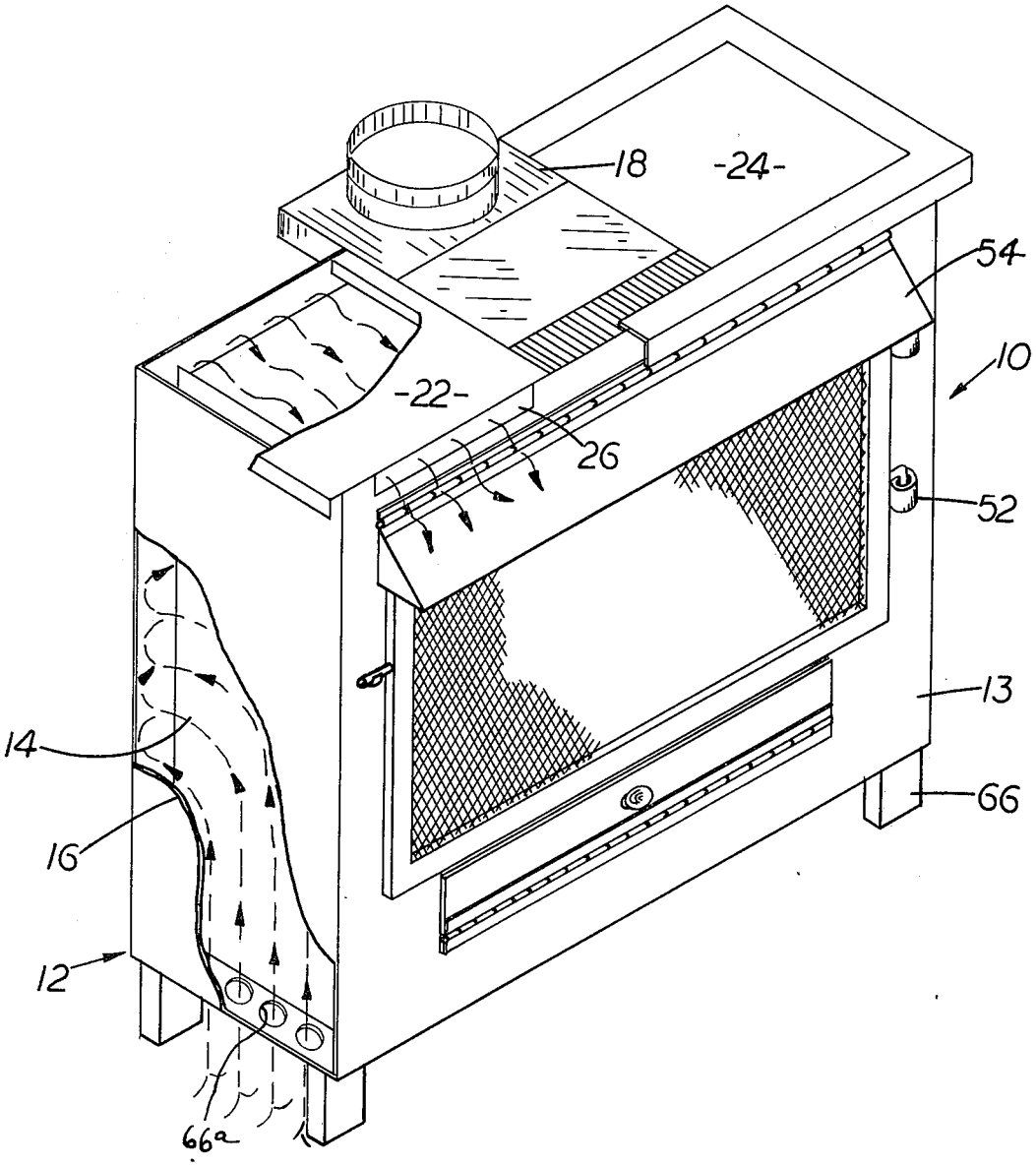
FIG. 1 is a perspective view of a stove embodying the principles of the invention with portions of the frame means of the stove broken away to show the interior construction of the stove and heat flow channel therethrough.
Figure 2:
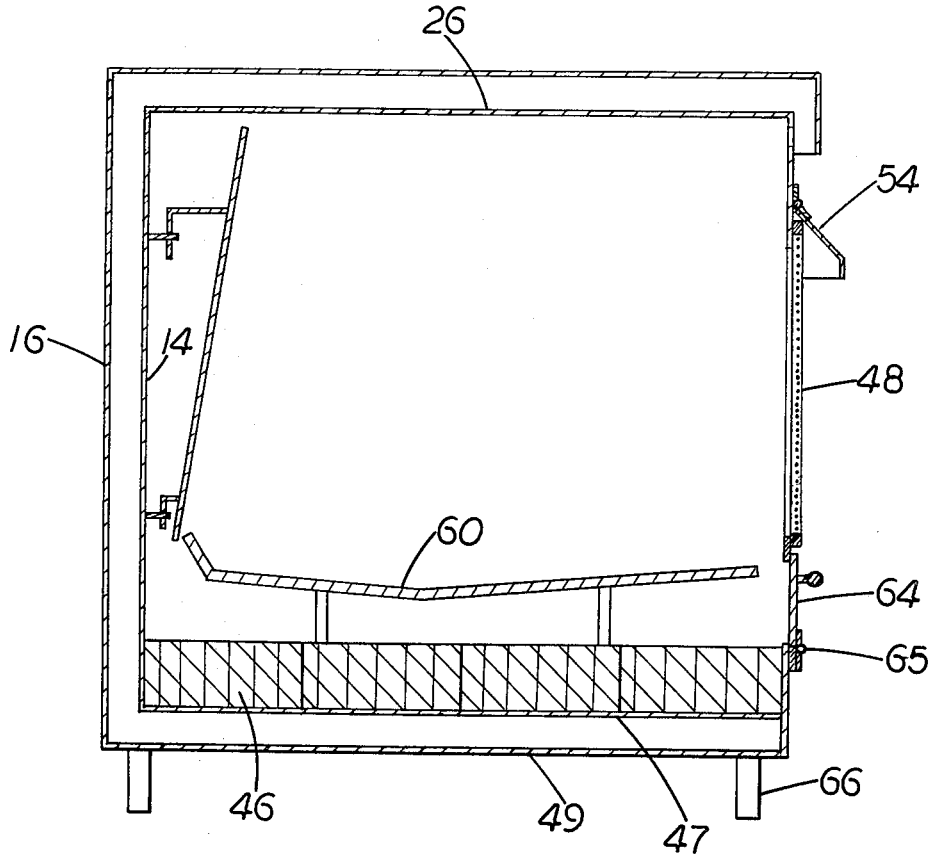
FIG. 2 is a vertical section of the stove of FIG. 1 taken on a line offset from the center thereof.
Figure 4:
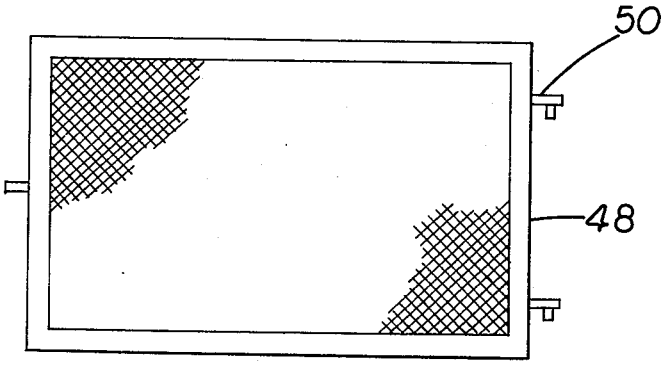
FIG. 4 is an elevation of a door for the stove of FIG. 1.
Figure 5:
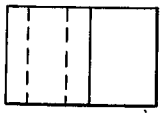
FIGS. 5 and 6 are elevation and plan views of a hinge means used on the stove door.
Figure 6:
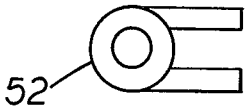

FIG. 2 of the drawings best shows that a removable screen or door 48 is provided at an opening in the front 13 of the stove and it normally has hinges 50 extending from one end thereof for being removably engaged with hinge sockets 52 secured to a vertical margin at the door opening in the front of the frame means. A hood 54 is provided on the front portion of the frame means as indicated at 56, and the hood 54 vertically overlaps the upper end of the door 48. Hence when the hood is in its operative lowered position, the door is retained in its closed position whereas when the hood is swung upwardly, then the door or screen can be opened or removed when desired.

A conventional grate 60 is carried by the layer of bricks 46 or other floor means provided in the stove, and the support legs for this grate 60 preferably are adjacent the lateral margins thereof so that an ash remover or shovel can be slid in between the support legs over the bricks 46 to collect and remove the ashes. A cover or door 64 is provided at the front section of the frame and can be hinged at 65 at its bottom thereof to provide access to the ash pit. Such door is retained in its closed normal operative position in any conventional manner.

Any desired type of support legs 66 are suitably secured to the frame means 12 at marginal bottom portions thereof to elevate the stove above its support surface. Hence air can readily flow into the frame means through openings 66*a* provided in the bottom 49 to that air can flow between the spaced walls 14 and 16 of the frame means and flow up around the back of the frame means for ultimate flow through the horizontally positioned ducts 26 formed in the frame means adjacent each lateral top portion thereof. Such ducts are open to the front of the stove whereby air can exhaust from the stove out into the surrounding atmosphere to provide an effective heating action therefor.

The cooking plate 32 preferably has a plurality of bottom ribs 70 provided thereon radiating from a center flange 72 on this plate and this aids the plate in accepting wide temperature variations without damage.

Figure 8:
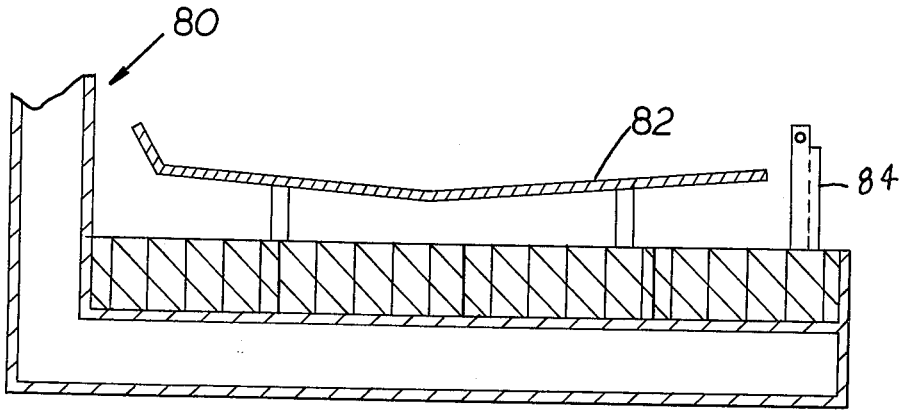
FIG. 8 is a fragmentary vertical section through a fireplace or stove and grate means.
Figure 9:
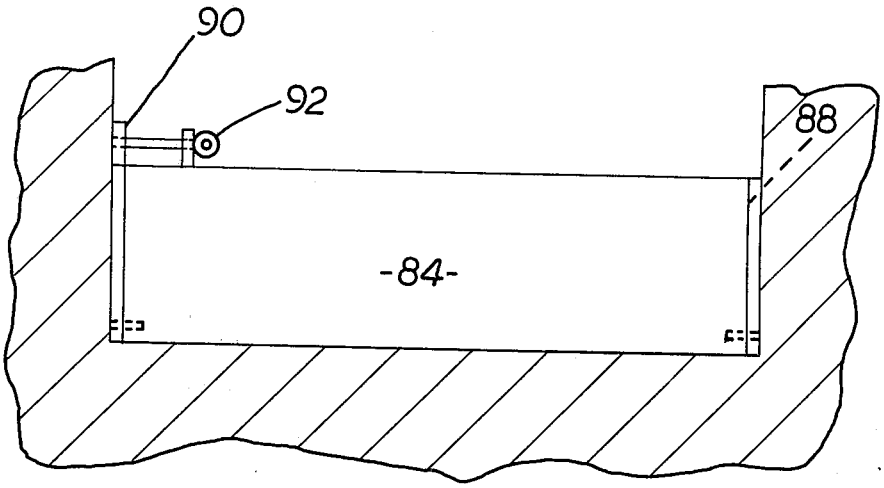
FIG. 9 is a fragmentary front elevation of the stove or grate means shown in FIG. 8.

The invention also includes a modified structure shown in FIGS. 8 and 9 wherein a conventional fireplace 80 is partially indicated having a grate 82 positioned therein. So as to prevent any air from entering the fireplace below material supported on the plate for combustion, a plate or draft control door 84 is secured in the lower portion of the fireplace opening 86 and it may be pivotally attached to bars 88 and 90 suitably attached to side edge portions of the fireplace or fire chamber opening. A lock pin 92 is usually carried by the upper edge of this draft control or door to retain it in operative position but to permit it to be lowered to facilitate ash removal from the fireplace, or for other purposes as desired. By this construction, as in the stove 10 of the invention the entry of air into the fire chamber from below the grate is prevented. Thus, the rate of combustion of the materials in the fireplace can be controlled and a slower combustion rate is obtained than in conventional fireplaces. Hence, the present invention does provide means for controlling the combustion rate in fireplaces or stoves and an improved heating action can be obtained when the invention is used on a stove as shown hereinbefore.

Obviously the damper or door 64 provided in the stove will extend laterally thereof the full opening of the fire chamber.

It also will be recognized that the metal plate 32 preferably is a metal casting and it preferably is formed from aluminum for good heat retention action.

The type of grate means used in the fireplace or stove of the invention is of any conventional shape, and the air draft control door provided extends up to substantially the upper portion of this grate insofar as it effectively supports fuel for combustion in the fire chamber.

In use of the stove of the invention, it has been found that a very slow, controllable burning action is achieved in the stove and that the rate of combustion can be even further controlled by closing the damper 39 as much as three-fourths of its full closure position and that no smoke flows from the stove into the room. Usually the damper 39 will have some small apertures 39*a* therein. For example, in a damper positioned in an 8 inch flue, the total area of the holes in the damper would be approximately 4 square inches so that some gas flow through the damper will occur at all times.

The stove will effectively heat large areas such as rooms or a combination of rooms as much as 30 × 50 ft. in area.

It also has been found that the cast aluminum cook plate used in the stove will retain heat therein for up to several hours after the combustion in the stove has terminated. By withdrawing heat from the combustion gases in the stove, either by the heater duct means provided, or by the aluminum metal cook plate in the stove, the gases passing out of the flue are at a sufficiently low temperature that a single thickness metal pipe can be used as the flue without heating excessively.

A controllable combustion and heating action is obtained while the stove also can be used for cooking if desired. Thus the objects of the invention have been achieved.

While two complete embodiments of the invention have been disclosed herein, it will be appreciated that modification of these particular embodiments of the invention may be resorted to without departing from the scope of the invention.

What is claimed is:

1. A stove comprising:

a frame means including spaced inner and outer walls with the inner wall operatively defining a fire chamber, said frame means having an air inlet means formed therein at a lower portion thereof connecting to the space between said walls, said frame means also comprising a horizontally extending heater duct extending substantially the depth of said frame means at each end of said frame means, and connecting to the space between said walls, which ducts are positioned at the upper portion of the frame means and are open at the front of the stove for discharge of heated air, and are open at the rear of the frame means to the space between said walls to receive air flowing up between said walls, said frame means including a top section having a flat top surface with a center opening therein between said ducts and directly above the fire chamber to have the combustion products flow directly upwardly thereto, a metal plate positioned over said opening for receiving food thereon to be cooked or warmed by the stove, the combustion products contacting the lower surface of said plate and an exhaust stack operatively connected at its lower end to said frame means at a rear portion thereof at the level of said metal plate for flow of the combustion products up against said metal plate and then horizontally rearwardly to and up said exhaust stack.

2. A stove as in claim 1, where a movable ash door means is positioned at a bottom portion of the front of said frame means where the fire chamber is formed and such door means and associated portions of the front of said frame means closes the fire chamber up to about the top of a grate means received in the fire chamber, and fire brick members forming a floor for said fire chamber, said grate means being adapted to position combustible members thereon spaced from and above said fire brick members.

3. A stove as in claim 1, where the stove has an open front portion, a screen member positioned over said open front portion and pivotally secured to the stove for horizontal pivotal opening movement, and a hood means pivotally secured to the stove and covering the upper section of said open front portion, said hood means being movable upwardly to permit opening movement of said screen and access to a fire chamber formed in the stove, said hood means having an operative position engaging said screen to retain it in position over said open front.

4. A stove as in claim 2 where said air inlet means are provided at the bottom of said frame means on the sides and back of the stove and air flow between said walls passes to the back of said stove at laterally spaced portions thereof to flow to said ducts, and a damper is present in said exhaust stack.

5. A stove comprising:

a frame means including spaced inner and outer walls with the inner wall operatively defining a fire chamber, said frame means having an air inlet means formed therein at a lower portion thereof connecting to the space between said walls, said frame means also comprising horizontally extending spaced inner and outer top walls extending substantially the depth of said frame means at each end of said frame means to form air heater sections connecting to the space between said walls, the space between said inner and outer top walls being open at an upper portion of the stove for discharge of heated air, said frame means including a top section having a flat top surface with a center opening therein between said heater sections and directly above the fire chamber to have the combustion products flow directly upwardly thereto, a metal plate positioned over said opening, the combustion products contacting the lower surface of said plate to heat the same, and an exhaust stack operatively connected at its lower end to said frame means at a rear portion thereof, said exhaust stack connecting to the fire chamber and having its lower end at substantially the level of said plate for flow of the combustion products in a substantially horizontal path from said plate to said exhaust stack.

* * * * *